United States Patent [19]

Geiger

[11] Patent Number: 4,899,634

[45] Date of Patent: Feb. 13, 1990

[54] BRIDGE FOR STRINGED MUSICAL INSTRUMENTS

[76] Inventor: John F. Geiger, 190 Berwick Dr., NE., Atlanta, Ga. 30328

[21] Appl. No.: 335,875

[22] Filed: Apr. 10, 1989

[51] Int. Cl.[4] ..... G10D 3/04

[52] U.S. Cl. ..... 84/307; 84/299; 84/308; 84/309

[58] Field of Search ..... 84/298, 299, 307, 308, 84/309, 314

[56] References Cited

U.S. PATENT DOCUMENTS

| | | | |
|---|---|---|---|
| 642,416 | 1/1900 | Beetem | 84/309 |
| 1,783,117 | 11/1930 | Gosparlin | 84/309 |
| 2,309,082 | 1/1943 | Smith et al. | 84/314 N |
| 2,446,267 | 8/1948 | Dahn | 84/309 |

*Primary Examiner*—Lawrence R. Franklin
*Attorney, Agent, or Firm*—Thomas & Kennedy

[57] ABSTRACT

A bridge for a stringed musical instrument comprises a thin wooden body having a bottom base portion adapted to be supported upon a resonant body member of the instrument and a top crown portion that is formed with grooves for holding individual strings. The base and crown portions have opposed edges that are generally parallel with respect to each other. The crown is formed with baffle slits located adjacent the grooves that are oriented obliquely with respect to the crown edge for redirecting sound waves emitting from strings back to the grooves to produce a ringing tonal effect or to the base to reduce sound attenuation within the bridge.

3 Claims, 3 Drawing Sheets

BRIDGE FOR STRINGED MUSICAL INSTRUMENTS

TECHNICAL FIELD

This invention relates to stringed musical instruments such as banjos, guitars and mandolins, and particularly to bridges used to hold the strings of such instruments over their resonant bodies and for transmitting string generated sounds thereto.

BACKGROUND OF THE INVENTION

The strings of many types of musical instruments are held and supported over their resonant bodies by means of a small, upright member known as a bridge. The bridge, which is usually formed of a thin, hand crafted wooden slab, has a set of grooves along one of its edges in which the strings are tautly held. In the case of banjos, the bridge is mounted unattachedly upon the resonant diaphragm or head of the banjo and held in place by the strings.

Heretofore, bridge designs have been focused on attempts to limit sound wave energy absorption and dissipation within the bridge itself and to enhance the tonal clarity of the sounds transmitted by the bridge. As exemplified by the bridge shown in U.S. Pat. No. 4,667,559, design attempts at achieving this goal have been directed principally at shaping the periphery of the bridge in complex manners on a trial and error basis. These bridges have been both costly and difficult to reproduce, particularly with consistency.

Accordingly, it is seen that a need remains for a stringed instrument bridge of relatively simple and reproducible construction and with enhanced sound transmission characteristics. It is to the provision of such that the present invention is primarily directed.

DETAILED DESCRIPTION

Figure 1:
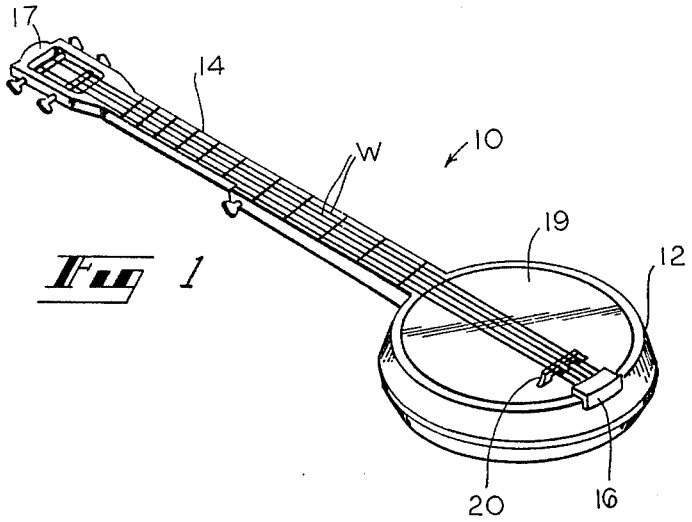
FIG. 1 is perspective view of a conventional five-string banjo.

Referring now in detail to the drawing, there is shown in FIG. 1 a conventional banjo 10 which has a resonator head or pot 12 from which an elongated neck 14 extends that provides a fretted finger board. Five wire strings W are mounted to a tailpiece 16 and to a pegged scroll 17 so as to extend tautly over the fretted neck. A bridge 20 is detachedly placed upon the head diaphragm 19 and supports the strings in a side-by-side spaced array.

Figure 3:
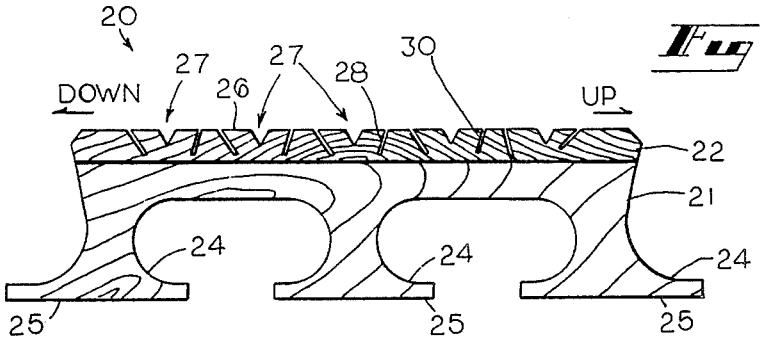
FIG. 3 is a side elevational view of a five-string banjo bridge that embodies principles of the invention in another preferred form.

With reference to FIG. 3, the bridge 20 is seen in greater detail as having a two-piece, thin wooden body 21. The body has a bottom base portion 21, which typically is made of maple, and a top crown portion 22, which typically is made of ebony. The base here has three spaced feet 24 which have mutually coplanar, flat bottom edges 25 adapted to be set directly upon the diaphragm 19. The crown 22 has a top edge 26 which is generally flat and oriented substantially parallel with respect to the feet edges 25.

The crown 22 is conventionally formed with five mutually spaced V-shaped grooves 27 in which the five banjo strings W are held. Each of these grooves is seen to be straddled by a pair of slits 28 and 30 that extend deeper into the crown than do the grooves 27. The slits of each pair here are also seen to extend obliquely from the crown edge 26 and to extend from the edge 26 mutually convergently about grooves.

Figure 4:
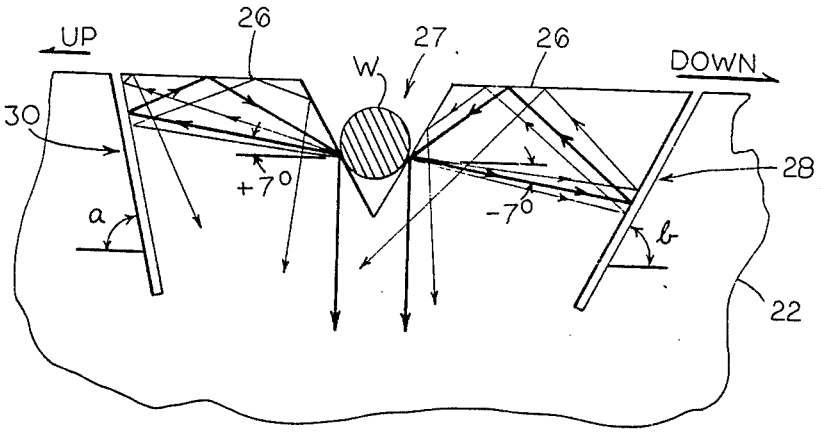
FIG. 4 is a diagrammatical view of sound transmissions in the bridge shown in FIG. 3.

As seen most clearly in FIG. 4, each slit 30 extends from the crown edge 26 at an angle a while each slit 28 extends from the crown edge 26 at a different angle b. This is to accommodate for the fact that each string is set in vibration along a plane non-parallel to the banjo head, and this plane is roughly 7° , positive or negative, as indicated in FIG. 4. Strings are normally picked along different 7° planes by the fingers and the thumb, as is common with 5-string banjos, requiring the combination of cuts on the top string to be mirrored. Thus, angles a and b differ by roughly some 14° here. However, this angular difference may vary somewhat because of irregularities in the wood and particularly where the crown edges 26 to each side of a groove are not exactly coplanar or where the distance between each slit and the groove varies significantly. For example, an angle a of 79° and an angle b of 65° has been found to produce excellent musical results.

The slit angles a and b are established here so that sound waves generated by a plucked string W, which primarily radiate laterally through the bridge, are baffled by the slit and reflected to the crown edge 26. From here they are reflected back to the groove and from the groove downwardly towards the bridge base and the banjo diaphragm. In this manner sound sustention is obtained as well as a ringing effect produced. The sustenance is believed to be achieved by the fact that some waves recirculate many times in the groove-slit-edge-groove circuit before being promulgated to the bridge base and diaphragm. A ringing tonal effect is believed to be derived from the frequency phase shifts created.

In actuality, of course, sound waves propagate in many directions through the bridge when a string is vibrating. Thus the heavy lines with arrows in FIG. 4 denote that particular path of wave travel that occurs from the point of wire contact with the groove to in the precise direction of normal string movements. It should be understood, of course, that all angles of reflections here are equal but opposite to the angles of wave incidences, and that the change in medium from wood to air at the slits' edge and groove creates the reflections. Since the slits are located so closely to the grooves, lateral emanating sound waves are quickly directed downwardly to the bridge base and to the diaphragm with minimal attenuation. The result is added volume, clarity and a ringing tonal quality.

Figure 2A:
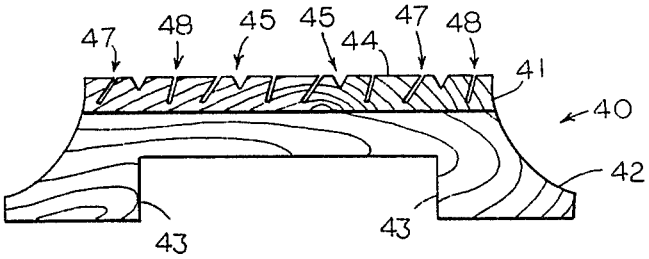
FIG. 2*a* is a side elevational view of a four-string banjo bridge that embodies principles of the invention in a preferred form.
Figure 2B:
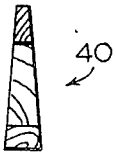
FIG. 2*b* is an end elevational view of the bridge.
Figure 5:
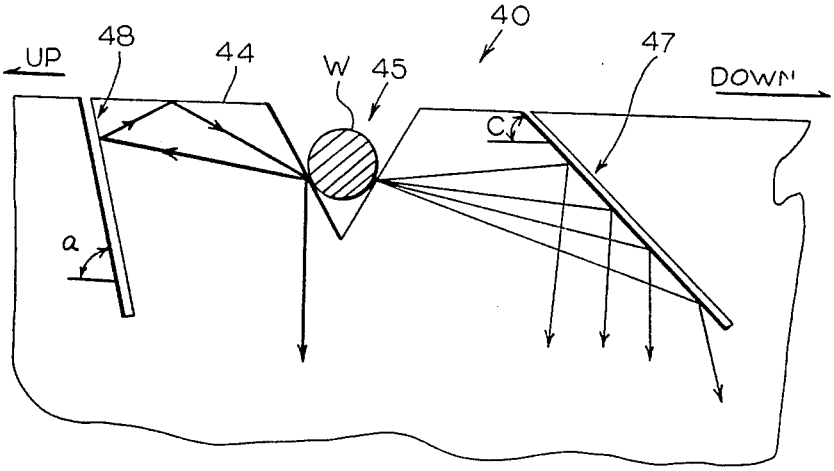
FIG. 5 is a diagrammatical view of sound transmissions in the bridge shown in FIG. 2.

With reference next to FIGS. 2 and 5, a four-string banjo bridge 40 is shown which has a crown 41 and a base 42 that has two base feet 43. The crown has a top edge 44 which is formed with four wire string holding grooves 45. A plurality of slits is again formed in the crown such that a pair of slits 47 and 48 straddles each groove. Each of the slits 48 here is essentially the same as the slits 30 in the previously described embodiment and serves the same function. Each of the slits 47 however is seen to extend obliquely from the crown edge 44 at an angle to redirect sound waves travelling generally laterally from a wire W held within a groove 45 downwardly towards the base portion of the bridge. This serves to amplify the sound in the sense that the sound ultimately generated by the banjo is louder than that generated with bridges made without this slit. This is believed to be attributable to the fact that the sound is directed to the bridge base and banjo diaphragm rather than to the side edges of the bridge where it is reflected back and forth through the bridge many times. Such back and forth propagations of sound waves results in energy dissipation and sound attenuation. It should be appreciated that, if desired, a single slit 47 may be formed between two adjacent string holding grooves to provide amplification from one of the grooves and sustenance from the other. The different angles for the slits that straddle the furthest right groove in FIG. 3 is to accommodate for the fact that the wire held in that groove is plucked by the thumb at a different angle of attack.

Figure 7:
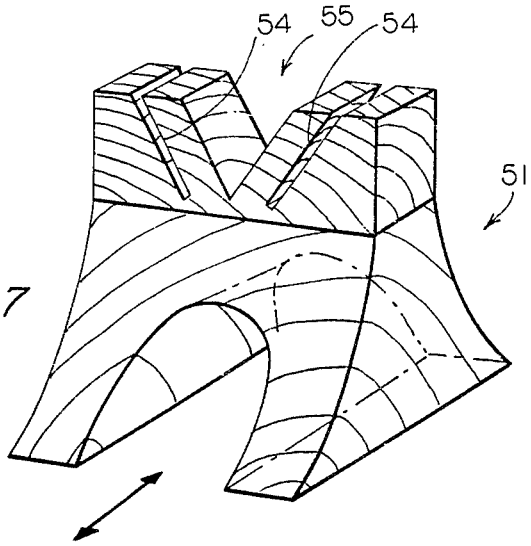
FIG. 7 is a perspective view of one segment in the tuning compensation bridge shown in FIG. 6.
Figure 6:
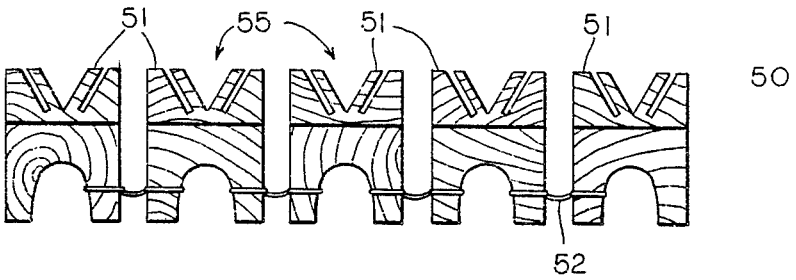
FIG. 6 is a front elevational view of a tuning compensation bridge that embodies principles of the invention.
Figure 8:
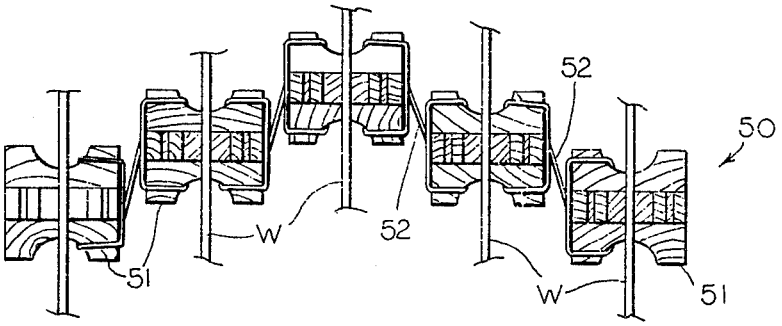
FIG. 8 is a plan view of the tuning compensation bridge of FIG. 6.

Finally, FIGS. 6–8 show principles of the invention as applied to a conventional tuning compensation bridge 50 that has five segments 51 coupled together by a safety string 52. Here it is seen that a pair of slits 54 straddle a wire receiving groove 55 frame formed in the crown with the slits extending convergently from the crown. As is well known by segmenting the bridge its location may be individually adjusted and set for each wire string for tuning compensation. Thus, in this application the term "bridge" is intended to include segmented type bridges as well as unitary bridges.

It thus is seen that a bridge is now provided for stringed musical instruments that enhances musical characteristics of the instruments. Though the bridge has been found to be uniquely well suited for use with banjos, it may be also used on other types of string instruments such as mandolins. In that case the base of the bridge is permanently mounted to the resonant chamber of the mandolin. Though two preferred embodiments have been illustrated and discussed in detail, many modifications, additions and deletions may be made thereto without departure from the spirit and scope of the invention as set forth in the following claims.

I claim:

1. A bridge for a strummed stringed musical instrument comprising a thin body having a bottom base portion adapted to be supported upon a resonant member of the instrument and a top crown portion that is formed with a plurality of V-shaped grooves for holding individual string members of the instrument, and a plurality of pairs of substantially straight baffle slits that extend convergently from said crown edge with each of said pairs of slits straddling a different one of said grooves and with each slit terminating to the same side of an adjacent groove from which it extends from said crown edge, and wherein said base and crown portions have opposed edges that are generally parallel with respect to each other, whereby some sound waves emitted from strings held within said grooves and propagated generally laterally through said crown portion are reflected by said baffle slits towards portions of said crown edge located closely adjacent said straddled V-shaped grooves, back onto said V-shaped grooves for enhanced sound sustention and from said grooves towards said bridge base.

2. A bridge for a strummed stringed musical instrument comprising a thin body having a bottom base portion adapted to be supported upon a resonant member of the instrument and a top crown portion that is formed with a plurality of V-shaped grooves for holding individual string members of the instrument, and a plurality of pairs of substantially straight baffle slits that extend divergently from said crown edge with each of said pairs of slits straddling a different one of said grooves, and wherein said base and crown portions have opposed edges that are generally parallel with respect to each other, whereby sound waves emanating from the string held with the groove straddled by a pair of baffle slits are reflected by at least one of said slits directly towards said bottom base portion for sound amplification.

3. The musical instrument bridge of claim 1 or 2 wherein the baffle slits of each of said pairs of slits extend from said crown edge at mutually different angles to accommodate for divergent downstroke and upstroke angles of attack made by strummed strings.

* * * * *